US008360110B2

(12) United States Patent
Gherardi

(10) Patent No.: US 8,360,110 B2
(45) Date of Patent: Jan. 29, 2013

(54) MACHINE FOR MAKING FABRICS COMPRISING YARNS DECORATED WITH PEARLS AND FABRIC COMPRISING YARNS DECORATED WITH PEARLS

(75) Inventor: Claudio Gherardi, Milan (IT)

(73) Assignee: Ghertex S.R.L., Cesate, Milan (IT)

( * ) Notice: Subject to any disclaimer, the term of this patent is extended or adjusted under 35 U.S.C. 154(b) by 218 days.

(21) Appl. No.: 12/991,147

(22) PCT Filed: May 5, 2009

(86) PCT No.: PCT/IB2009/005534

§ 371 (c)(1),
(2), (4) Date: Dec. 21, 2010

(87) PCT Pub. No.: WO2009/136276

PCT Pub. Date: Nov. 12, 2009

(65) Prior Publication Data

US 2011/0108152 A1 May 12, 2011

(30) Foreign Application Priority Data

May 7, 2008 (IT) ..... MI2008A0821

(51) Int. Cl.

| | |
|---|---|
| ***D03D 31/00*** | (2006.01) |
| ***D03D 47/23*** | (2006.01) |
| *D03D 41/00* | (2006.01) |
| *D03D 25/00* | (2006.01) |

(52) U.S. Cl. ..... 139/11; 139/447; 139/448; 139/450; 139/1 R

(58) Field of Classification Search ..... 139/11, 139/1 R, 116.1, 438, 443–448, 450
See application file for complete search history.

(56) References Cited

U.S. PATENT DOCUMENTS

| | | | | |
|---|---|---|---|---|
| 1,726,933 | A * | 9/1929 | St. John, Jr. | 223/48 |
| 1,821,504 | A | 9/1931 | Feiler | |
| 3,907,180 | A * | 9/1975 | Birk et al. | 223/48 |
| 4,044,446 | A * | 8/1977 | Segerman | 29/241 |
| 4,357,964 | A * | 11/1982 | Kohler | 139/448 |
| 5,395,245 | A * | 3/1995 | Heinz | 434/204 |
| 5,421,378 | A | 6/1995 | Bower et al. | |
| 5,494,734 | A * | 2/1996 | Widders | 442/2 |
| 5,664,707 | A * | 9/1997 | Spector | 223/48 |
| 6,719,013 | B1 * | 4/2004 | D'Estais | 139/29 |
| 7,147,008 | B2 * | 12/2006 | Sayler | 139/29 |

(Continued)

FOREIGN PATENT DOCUMENTS

| | | |
|---|---|---|
| DE | 31005 | 5/1884 |
| EP | 1036868 | 9/2000 |

(Continued)

*Primary Examiner* — Bobby Muromoto, Jr.
(74) *Attorney, Agent, or Firm* — King & Schickli, PLLC

(57) ABSTRACT

The machine (1) for making fabrics comprising yarns decorated with pearls (15) comprises a yarn holder (2) for feeding a warp yarn (3) to a weaving group (5) by aligning all of them onto the same plane by means of cords (7) controlling the feeding direction of the warp (3). The weaving group (5) comprises a reed (9) therethrough the warp yarns (3) pass and cooperating with a bar (11) for forming the fabric (8). The weaving cloth (5) comprises two pincers (13) suitable for inserting a weft yarn between the warp yarns (3). The bar (11) has an indentation (16) faced towards the reed (9) and placed at the passing area of the warp (14). The pincers (13) have a first jaw (18) faced towards a second jaw (19) with substantially triangular profile. The invention also relates to the fabric made with such machine.

8 Claims, 7 Drawing Sheets

U.S. PATENT DOCUMENTS

| | | | | |
|---|---|---|---|---|
| 7,677,273 | B2 * | 3/2010 | Skaflestad | 139/29 |
| 7,762,284 | B2 * | 7/2010 | Ricks | 139/29 |
| 7,909,066 | B2 * | 3/2011 | Wada | 139/29 |
| 8,066,035 | B1 * | 11/2011 | Stevens | 139/29 |
| 8,132,596 | B2 * | 3/2012 | Weidler et al. | 139/29 |
| 2004/0069363 | A1 | 4/2004 | D'Estais | |
| 2006/0162164 | A1 * | 7/2006 | Frisina | 29/896.43 |
| 2010/0163283 | A1 * | 7/2010 | Hamedi et al. | 174/254 |

FOREIGN PATENT DOCUMENTS

| | | |
|---|---|---|
| FR | 2264111 | 10/1975 |
| GB | 442265 | 2/1936 |
| JP | 8060490 | 3/1996 |
| JP | 2002088616 | 3/2002 |
| JP | 2008007866 | 1/2008 |
| WO | WO 02/088454 | 11/2002 |

* cited by examiner

MACHINE FOR MAKING FABRICS COMPRISING YARNS DECORATED WITH PEARLS AND FABRIC COMPRISING YARNS DECORATED WITH PEARLS

FIELD OF THE INVENTION

The present invention relates to a machine for making fabrics comprising yarns decorated with pearls and to a fabric comprising yarns decorated with pearls.

BACKGROUND OF THE INVENTION

As it is known, there are textile machines which allow making fabrics decorated in various ways, for example with various combinations of weft yarns and with colours or with even very complex figures.

However, the fashion field is continuously looking for new products and, in particular, fabrics allowing to make clothes with new and interesting features for the consumers.

To this regard fabrics decorated with pearls (wherein under pearls spherical or faceted elements or elements with any other solid geometrical shape are meant, for example with diameter equal to about 2 millimetres or 3 millimetres or more) made of glass or plastic or crystal or metal have always been very appreciated by consumers.

However, currently it is necessary implementing the fabric and subsequently applying the pearls as decorative motifs.

In fact, the manufacture of fabrics having the pearls directly in the weft was considered not implementable with the existing textile machines, as the machines during the operation inevitably cause the pearls' rupture and, therefore, the implementation of defective products and which cannot be marketed.

SUMMARY OF THE INVENTION

The technical aim of the present invention is then providing a machine allowing to eliminate the complained technical drawbacks of the known art.

Within the scope of this technical aim, an object of the invention is providing a fabric comprising a weft (meaning both the case wherein all weft yarns have pearls and the case wherein only some weft yarns have pearls) bearing (for example threaded or constrained in other way) pearls or other decorative motifs made up of spheres or solid geometrical figures having larger sizes with respect to the yarn and being substantially rigid; for example, the pearls are made up of elements made of plastic material, glass, crystal, metal or other material with a diameter of few millimetres (2 or 3 millimetres or more).

An object of the invention is also to providing a machine allowing to implement a fabric having the weft constituted by yarns bearing pearls.

The technical object, as well as these and other objects, according to the present invention are achieved by providing a machine for making fabrics comprising yarns decorated with pearls and a fabric comprising yarns decorated with pearls according to the enclosed claims.

BRIEF DESCRIPTION OF THE DRAWING FIGURES

Additional features and advantages of the invention will result better evident from the description of a preferred but not exclusive embodiment of the fabric and of the machine according to the invention, described by way of example and without limiting purposes in the accompanying drawings, wherein.

DETAILED DESCRIPTION OF THE INVENTION

Figure 1:
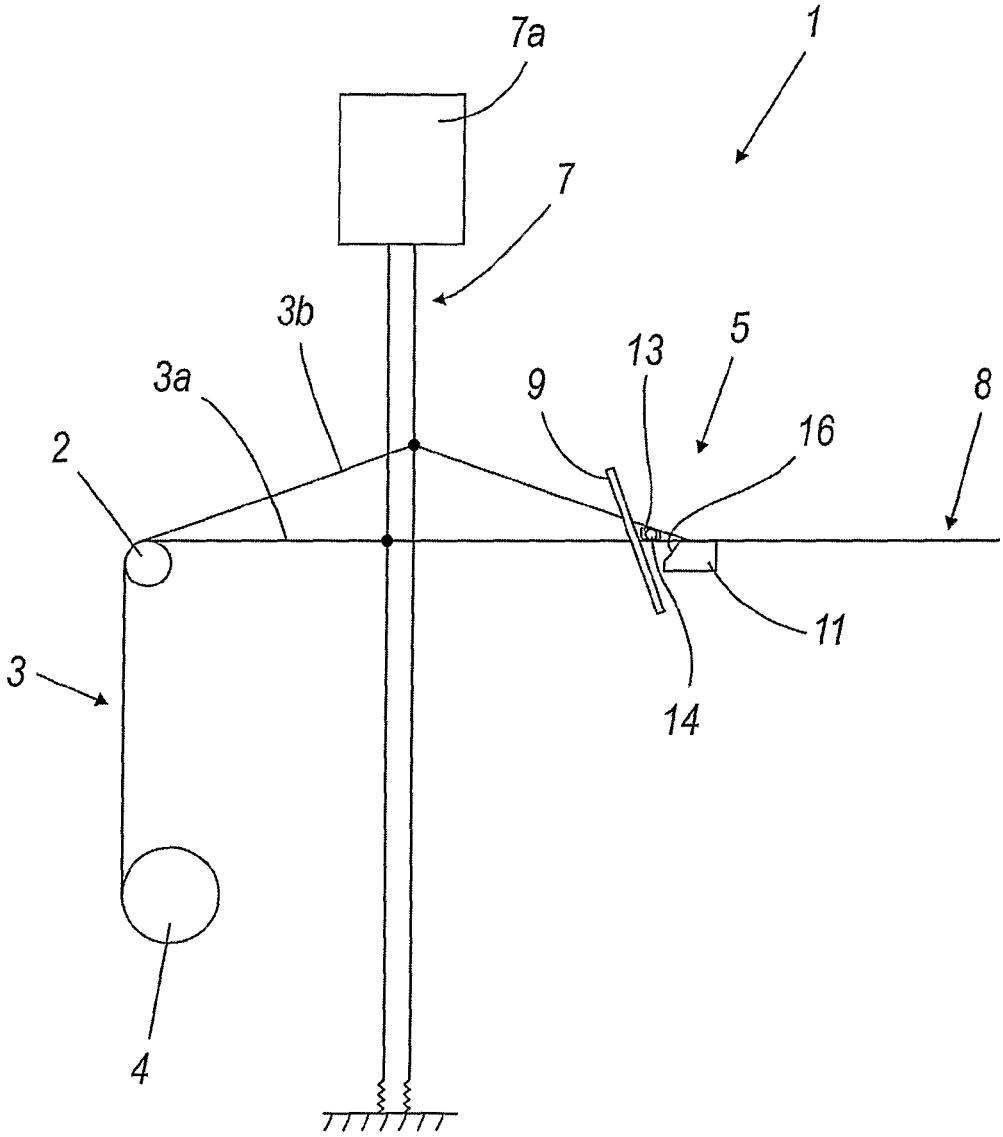
FIG. 1 shows a schematic view of the machine according to the invention.

By referring to the mentioned figures, a machine for making fabrics is shown comprising yarns decorated with pearls designated with the overall reference numeral 1.

In particular the warp is made up of single or twisted yarns, parallel one with another, and the weft is made up of by single yarns on which pearls are fixed made of glass, crystal or plastic material or metal or other material, for example inserted by means through holes thereof. The weft yarns can be formed by single yarns bearing fixed pearls or twisted yarns to which the pearls are fixed. To this respect, preferably the pearls are inserted in a first yarn of each twisted yarn and the other yarns of the twisted yarn are kinked around the first yarn, so as to keep the pearl substantially constrained in a defined position, however allowing a limited displacement of the pearl along the first yarn itself.

The machine 1 comprises a yarn holder 2 receiving the warp yarns 3 from a warp beam 4 and feeding them to a weaving group 5 by aligning all warp yarns on a same plane and by adjusting the tension of the terminal tract of the warp yarns.

In particular, (as however known) the warp yarns are fed to the weaving group 5 by means of cords 7 (connected to a jacquard device 7*a*) controlling the direction of feeding the warp yarns to the weaving group 5.

Thus, the cords 7 control some warp yarns 3*a* so that they have a horizontal direction of feeding to the weaving group 5 and other warp yarns 3*b* so that they are fed to the weaving group 5 from the top.

The weaving group 5 comprises a reed 9 through which the warp yarns 3*a*, 3*b* (both the horizontal yarns and the descending yarns) pass and which cooperates with a bar 11 for forming the fabric 8.

In known way, the weaving group 5 comprises also at least the pincers 13 suitable for transporting the weft yarns 14 (bearing the pearls 15) by inserting them between the warp yarns 3*a*, 3*b*.

In particular, the machine has two pincers 13, the first pincers make the weft yarns to cover a route corresponding to half width of the fabric which is implemented (inlet pliers) and the second pincers which take the weft yarns at the middle of the fabric which is being made and they cause them to travel along a stroke corresponding to a second half of the fabric which is implemented (outlet pincers).

The inlet pincers 13*a* have the jaws 18, 19 and a support for the yarn which is transported 30 and in the same way the outlet pliers 13*b* have jaws 18, 19 (these pincers have no support for the yarn 30) (however the pincers can be only one).

Both pliers 13*a*, 13*b* are integral to a driving rod 33, 34.

Each one of the pincers 13 has a first jaw 18 facing towards a second jaw 19 having converging outer side walls; advantageously the first jaw 18 has a substantially triangular profile with its own bevelled vertex 35.

In this way the pincers 13 are able to grasp the weft yarns 14 in a firm and safe way and there is not the risk that the pearls 15 get jammed between the jaws 18, 19 of the pincers 13; in fact, this would cause the weft yarns 14 to come out from the pincers 13 and machine 1 be stopped.

In fact, when the jaws of the pincers 13 close onto the weft yarns 14, in case a pearl 15 remains sandwiched between the jaws 18, 19 the pressure exerted by the same jaws 18, 19 and the particular triangular profile of the first jaw 18 cause the pearl translation along the weft yarn for a limited tract (arrow F), by removing the pearl from the position sandwiched between the jaws 18, 19. On the contrary, the weft yarn 14 remains trapped between the vertex of the first jaw 18 and the second jaw 19.

FIGS. 5 to 9 show various embodiments of the pincers' jaws which could be with triangular upper jaw (first jaw) and flat lower jaw (second jaw); with triangular upper jaw (first jaw) and dovetail lower jaw (that is with V-like recess, second jaw), with the triangular portion inserting into the V-like recess to keep the yarn; with flat upper jaw (second jaw) and triangular lower jaw 18 (first jaw); and with dovetail upper jaw (second jaw) and triangular lower jaw (inserting into the V-like recess, first jaw).

The bar 11 has an indentation 16 faced towards the reed 9 and placed at the passage area of the weft yarns (in particular of the horizontal yarns 3*a*).

Furthermore, as it is known, the bar is provided with a groove 11*a* for inserting the temple which keeps the fabric raised.

As shown, the bar 11 has a squared profile and the indentation 16 is defined by a bevelling.

The reed 9 has a plurality of teeth 25 defining openings 26 through which the warp yarns 3 pass.

Advantageously, the reed 9 has at least 1 tooth 25 for each centimeter of the reed 9, preferably at least 3 teeth 25 per centimeter of the reed 9 and more preferably about 3.3 teeth 25 per centimeter of the reed 9.

In this way, as the pearls 15 (which have a diameter of 2 or 3 millimetres) have a diameter smaller than the width of the openings 26, when the reed 9 strikes onto the bar 11, the pearls 15 insert into the openings 26 and avoid striking violently onto the teeth 25 by damaging them (for example by scratching them or chipping them); in fact teeth damaged (scratched or chipped) during the operation tend to break the weft yarns 14 and/or the warp yarns 3.

In particular the machine is of electronic jacquard type with a control of each single cord 7 independent from all other cords (that is each cord can be raised independently from the other ones); this allows to control raising each single cord 7 and, therefore, to control the direction of feeding each single warp yarn 3 to the weaving group 5.

This allows increasing the machine operation speed, as when the pincers 13 start crossing the warp yarns 3 each cord 7 which has been surpassed by the pincers 13 can move, with no need to wait that the same pincers 13 have crossed the whole width of the fabric.

The operation of the machine according to the invention appears clear from what described and illustrated and, in particular, it is substantially the following.

The warp yarns 3 unwind from the warp beam 4, they slide onto the yarn holder 2 and cross eyelets of the cords 7; then they cross the reed 9 and form the fabric 8.

Figure 2:
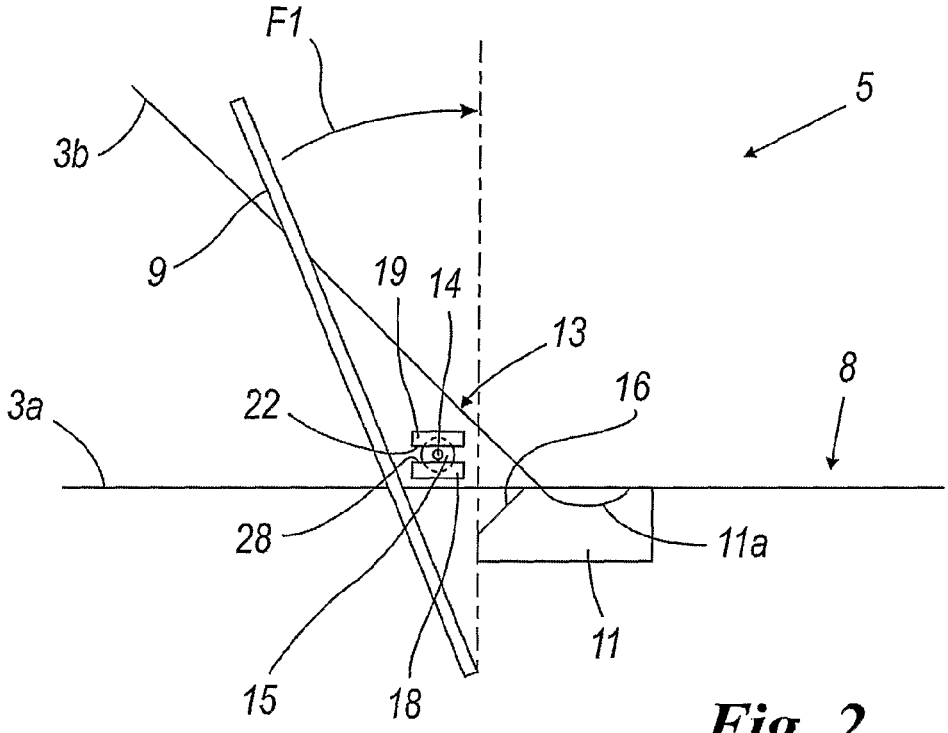
FIGS. 2 and 3 show a schematic view of a comb of the machine of FIG. 1 in two different operating phases.

FIG. 2 shows a working phase wherein the reed 9 is spaced out by the bar 11.

In this case the first pincers 13*a* grasp a weft yarn 14 and they make it to cross the warp yarns 3 for half the width thereof, about in the middle (as however known) the first pincers 13*a* pass the weft yarn 14 to the second pincers 13*b*.

Each one of the pincers 13 is able to grasp and keep safely the weft yarn 14.

When the pincers have made the weft yarn to cross all warp yarns 3 (therefore the forming fabric) for the whole width thereof, the reed 9 rotates as shown by the arrow F1, by striking against the bar 11 and tightening the warp yarns with the weft yarns.

Figure 3:
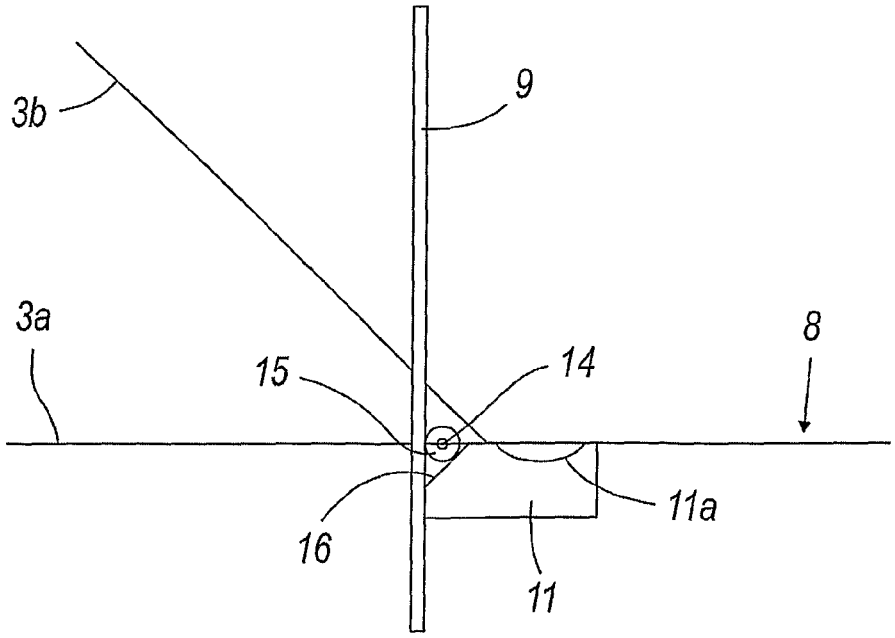
Figure 4:
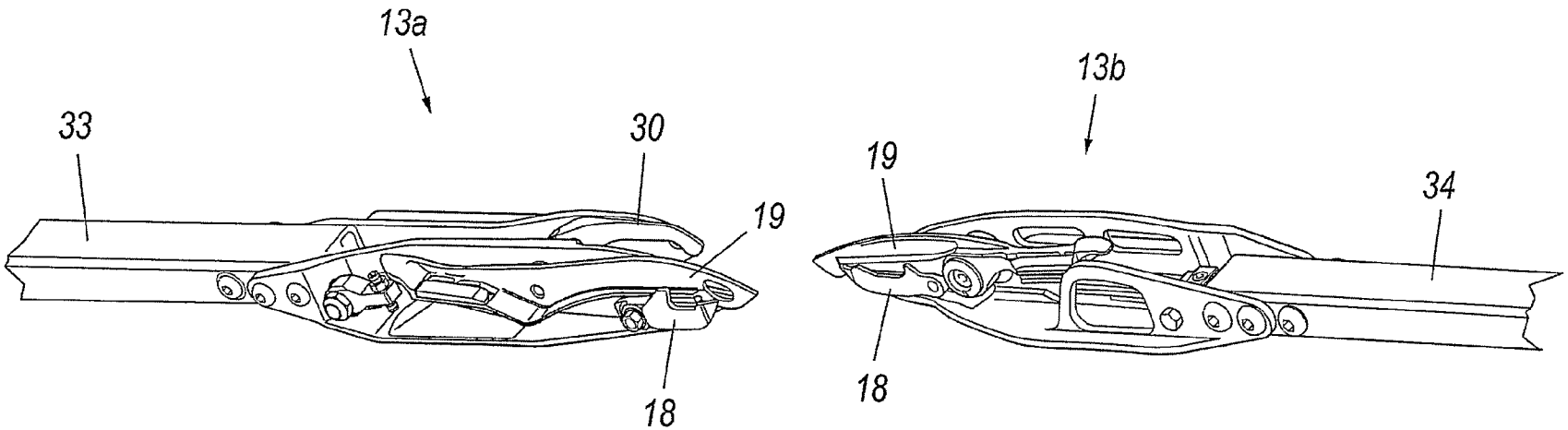
FIG. 4 shows a view of inlet pliers and outlet pliers faced therebetween.
Figure 5:
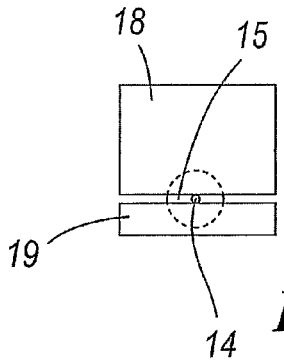
FIG. 5 shows a side view of the pliers of the machine of FIG. 1.
Figure 6:
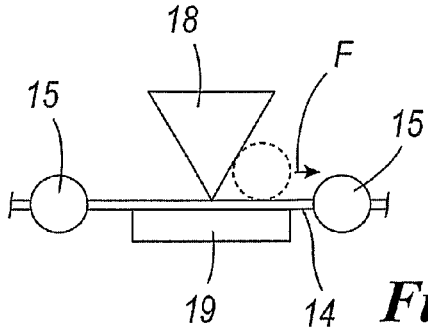
FIGS. 6 to 9 show, each one, a front view of the pliers in different embodiments.
Figure 7:
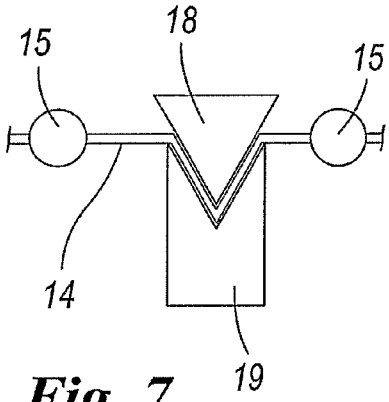
Figure 8:
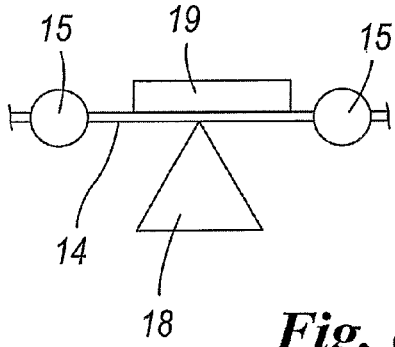
Figure 9:
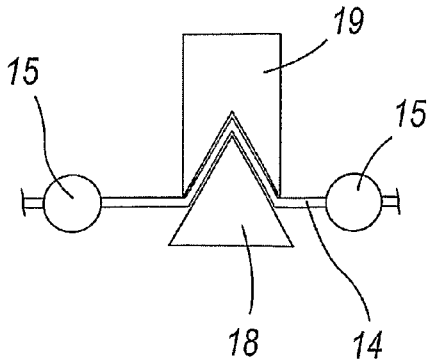
Figure 10:
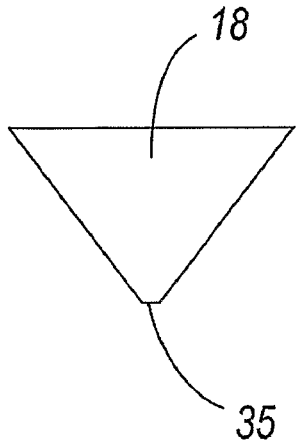
FIG. 10 shows an enlarged section of a portion of a triangular jaw.
Figure 12:
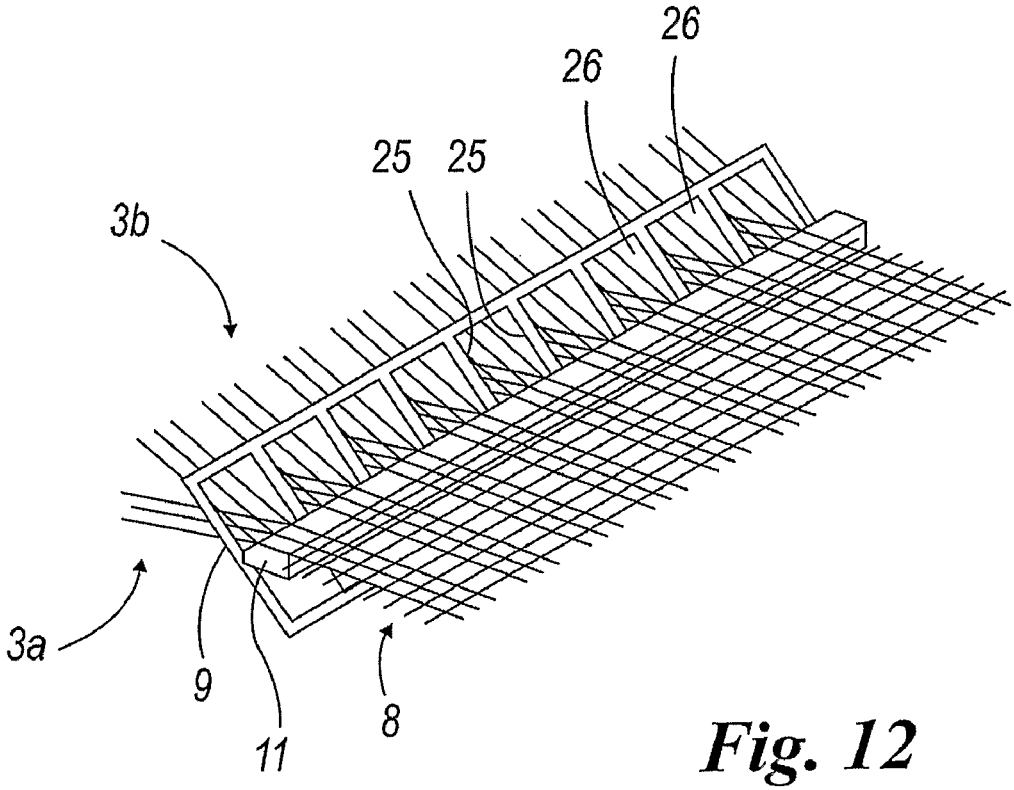
FIG. 12 shows a schematic perspective view of a comb associated to a bar.
Figure 11:
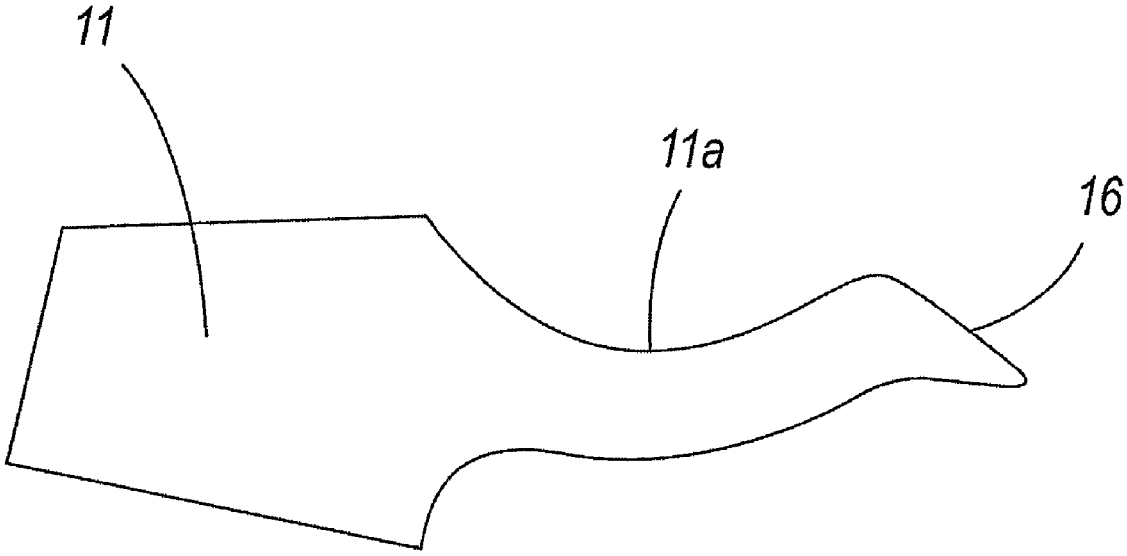
FIG. 11 shows a cross section of a bar.
Figure 13:
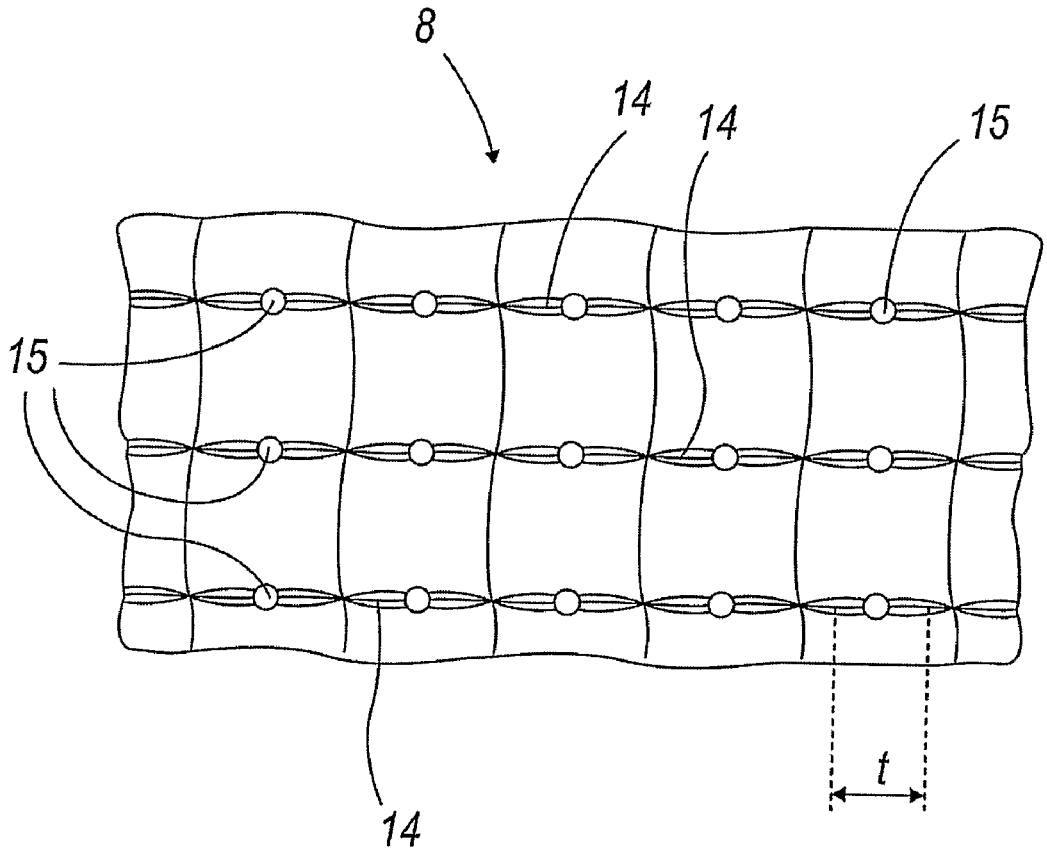
FIG. 13 shows a portion of fabric according to the invention.

When the reed 9 strikes against the bar 11 (FIG. 3) the pearls 15 insert into the indentation 16; therefore the pearls 15 are not hit violently by the bar 11; this avoids their rupture thereof.

Additionally, the high width of the openings 26 placed between the teeth 25 avoids that the pearls 15 (even when inserted into the indentation 16) can hit the teeth 25 by damaging them; this would limit considerably the operating life of the reeds 9.

Subsequently, the reed 9 returns again in the position of FIG. 2, the cords 7 translate modifying the direction of feeding the warp yarns 3 to the weaving group 5 according to the pre-set design which has to be produced on the fabric.

The warp yarns 3 move forward and a new weft yarn 14 is inserted therebetween.

The present invention also relates to a fabric 8 comprising yarns decorated with pearls 15 which define the weft 14 thereof, and yarns 3 made of natural or synthetic or artificial or mineral or metallic fibres or other fibres (without pearls) which define the warp yarns thereof.

Advantageously the weft 14 is made up of yarns made of natural (animal or vegetal) or synthetic or artificial or mineral or metallic or other fibres to which the pearls are fixed.

Advantageously, the pearls are fixed to the weft yarns 14 so that each pearl can slide onto the weft yarn 14 to which it is constrained for a limited tract.

To this regard the weft yarns 14 are formed by twisted yarns (for example three yarns twisted one with another as in the shown figures) and the pearl is equipped with a through hole wherein a first yarn of the three twisted yarns is inserted, whereas the other two yarns are twisted (that is kinked) to the first yarn so as to lock the pearl sliding along the first yarn.

Although the sliding is prevented, the weft yarns implemented in this way allow the pearls' sliding for a limited tract t.

The pearls are elements made of crystal or glass or plastic material or metal or other material; advantageously the pearls are crystals with diameter of 2 or 3 millimetres or even other (larger or smaller) sizes.

In practice, it was observed that the machine according to the invention is particularly advantageous as it allows to manufacture, in limited periods of time and in an economically advantageous way, fabrics which are very appreciated by the consumers.

In practice the used materials, as well as the sizes, can be anyone according to the needs and to the state of art.

The invention claimed is:

1. A machine for making fabrics comprising yarns decorated with pearls, said machine comprising a yarn holder for feeding a warp yarn to a weaving group by means of cords controlling the direction of feeding the warp yarns to said weaving group, wherein said weaving group comprises a reed therethrough the warp yarns pass and cooperating with a bar for forming the fabric, said weaving group further comprising at least one pincers suitable for transporting a weft by inserting it between the warp yarns, wherein said bar has an indentation faced towards said reed and arranged at the passing area of the weft and said at least one pincers have at least a first jaw faced towards a second jaw with converging side walls, wherein said converging side walls form a profile of said first jaw for causing pearl translation along the weft for a limited tract while the weft remains trapped between the jaws.

2. The machine according to claim 1, wherein said converging side walls form a triangular profile of said first jaw.

3. The machine according to claim 2, wherein a vertex of said triangular profile of said first jaw is smooth or bevelled.

4. The machine according to claim 1, wherein said pincers have the second jaw with plane surface facing the first jaw.

5. The machine according to claim 1, wherein said pincers have the second jaw with a surface facing the first jaw provided with a recess wherein a triangular portion of the first jaw can enter at least partially.

6. The machine according to claim 1, wherein the reed has a plurality of teeth defining openings through which said warp yarns pass, wherein said reed has at least one tooth for each centimeter of the reed, preferably at least three teeth per centimeter of the reed and more preferably about 3.3 teeth per centimeter of the reed.

7. The machine according to claim 1, wherein the machine is of jacquard type.

8. The machine according to claim 6, wherein the machine is of electronic jacquard type with control of each single cord independent from the other cords.

* * * * *